US010450802B2

(12) United States Patent
Kannegaard

(10) Patent No.: US 10,450,802 B2
(45) **Date of Patent: *Oct. 22, 2019**

(54) MOBILE OFFSHORE DRILLING UNIT, A METHOD OF USING SUCH A UNIT AND A SYSTEM COMPRISING SUCH A UNIT

(71) Applicant: MAERSK DRILLING A/S, Kgs. Lyngby (DK)

(72) Inventor: Michael Kannegaard, Espergaerde (DK)

(73) Assignee: Maersk Drilling A/S, Kgs. Lyngby (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,522

(22) Filed: Feb. 5, 2019

(65) Prior Publication Data

US 2019/0169936 A1 Jun. 6, 2019

Related U.S. Application Data

(63) Continuation of application No. 15/528,626, filed as application No. PCT/DK2015/000048 on Nov. 20, 2015, now Pat. No. 10,227,824.

(30) Foreign Application Priority Data

Nov. 20, 2014 (DK) ..... 2014 70712

(51) Int. Cl.
*E04B 1/34* (2006.01)
*E21B 15/00* (2006.01)
(Continued)

(52) U.S. Cl.
CPC ..... *E21B 7/128* (2013.01); *E02B 17/0034* (2013.01); *E02B 17/021* (2013.01);
(Continued)

(58) Field of Classification Search
CPC ..... E02B 17/021; E02B 17/04; E02B 17/02; E02B 2017/0039; E02B 2017/0082;
(Continued)

(56) References Cited

U.S. PATENT DOCUMENTS 1,128,039 A * 2/1915 Piercy ..... E02B 17/021 212/225
3,477,235 A * 11/1969 Hester, Jr. ..... E02B 17/00 175/5
(Continued)

FOREIGN PATENT DOCUMENTS

CN 101575946 B 8/2011
EP 2500259 A1 9/2012
(Continued)

OTHER PUBLICATIONS

International Search Report (PCT/ISA/210) dated Mar. 10, 2016, by the European Patent Office as the International Searching Authority for International Application No. PCT/DK2015/000048.
(Continued)

*Primary Examiner* — Benjamin F Fiorello
*Assistant Examiner* — Edwin J Toledo-Duran
(74) *Attorney, Agent, or Firm* — Buchanan Ingersoll & Rooney PC

(57) ABSTRACT

An offshore well-processing system includes a mobile offshore drilling unit and a remote well-processing device configured to be positioned on an offshore platform different from the mobile offshore drilling unit, the mobile offshore drilling unit defining at least one well center and comprising at least one primary drill rig including at least one drill floor and at least one hoisting system for raising and lowering tubular equipment through the at least one well center from/into a well in the seafloor. The mobile offshore drilling unit and the remote well-processing device are configured to
(Continued)

be operationally coupled to each other; and the mobile offshore drilling unit is configured to assist in performing concurrent well-processing tasks on respective wells, including the first well processing task performed by the remote well-processing device on a first well and a second well-processing task concurrently performed by the offshore well-processing system on a second well.

6 Claims, 4 Drawing Sheets

(51) Int. Cl.

| | |
|---|---|
| ***E21B 17/02*** | (2006.01) |
| ***E21B 7/128*** | (2006.01) |
| ***E02B 17/00*** | (2006.01) |
| ***E21B 11/02*** | (2006.01) |
| ***E21B 15/02*** | (2006.01) |
| ***E21B 29/12*** | (2006.01) |
| ***E02B 17/02*** | (2006.01) |
| ***E21B 29/00*** | (2006.01) |
| *E21B 7/124* | (2006.01) |

(52) U.S. Cl.
CPC ..... *E21B 11/02* (2013.01); *E21B 15/02* (2013.01); *E21B 29/00* (2013.01); *E21B 29/12* (2013.01); *E02B 17/0017* (2013.01); *E21B 7/124* (2013.01); *E21B 29/007* (2013.01)

(58) Field of Classification Search
CPC ..... E02B 2017/0073; E02B 2017/0056; E02B 2017/0047; B63B 35/4406; B63B 43/06; B63B 35/003
USPC ..... 405/196, 201, 202, 203, 204, 205, 206, 405/209; 175/5, 9, 73; 114/265
See application file for complete search history.

(56) References Cited

U.S. PATENT DOCUMENTS

| | | | | |
|---|---|---|---|---|
| 4,103,503 | A * | 8/1978 | Smith | E02B 17/021 405/196 |
| 4,208,158 | A | 6/1980 | Davies et al. | |
| 4,249,618 | A | 2/1981 | Lamy | |
| 4,483,644 | A * | 11/1984 | Johnson | E02B 17/021 175/9 |
| 4,618,286 | A | 10/1986 | Dominique | |
| 4,633,953 | A | 1/1987 | Leboeuf et al. | |
| 4,819,730 | A | 4/1989 | Williford et al. | |
| 4,938,628 | A * | 7/1990 | Ingle | C22C 38/22 405/196 |
| 5,558,037 | A | 9/1996 | Manning | |
| 6,171,027 | B1 * | 1/2001 | Blankestijin | E02B 17/021 175/5 |
| 6,491,477 | B2 * | 12/2002 | Bennett, Jr. | E21B 15/003 114/265 |
| 6,729,804 | B1 * | 5/2004 | Roodenburg | B63B 35/44 175/5 |
| 6,997,647 | B2 * | 2/2006 | Bennett, Jr. | E02B 17/021 405/201 |
| 7,628,224 | B2 | 12/2009 | D'Souza et al. | |
| 8,287,212 | B2 * | 10/2012 | Roper | E02B 17/00 405/196 |
| 8,439,606 | B2 * | 5/2013 | Foo | E21B 15/003 405/201 |
| 8,911,179 | B2 * | 12/2014 | Noble | E02B 17/0021 405/196 |
| 9,708,861 | B2 * | 7/2017 | Reddy | E21B 15/003 |
| 9,926,719 | B2 * | 3/2018 | Reddy | E21B 15/003 |
| 10,094,137 | B2 * | 10/2018 | Reddy | E04H 12/345 |
| 10,094,176 | B2 * | 10/2018 | Reddy | E21B 15/003 |
| 2002/0159840 | A1 * | 10/2002 | Bennett, Jr. | E21B 15/003 405/196 |
| 2009/0151955 | A1 | 6/2009 | Bamford et al. | |
| 2010/0071906 | A1 | 3/2010 | Rodrigues | |
| 2010/0108322 | A1 | 5/2010 | Eilertsen | |
| 2012/0067642 | A1 | 3/2012 | Magnuson | |
| 2015/0330048 | A1 | 11/2015 | Garder | |

FOREIGN PATENT DOCUMENTS

| | | | |
|---|---|---|---|
| WO | 0228702 | A1 | 4/2002 |
| WO | 2012142259 | A2 | 10/2012 |
| WO | 2012144952 | A1 | 10/2012 |
| WO | 2014163587 | A1 | 10/2014 |

OTHER PUBLICATIONS

Written Opinion (PCT/ISA/237) dated Mar. 10, 2016, by the European Patent Office as the International Searching Authority for International Application No. PCT/DK2015/000048. (11 pages).
Office Action dated Jul. 1, 2015, by the Danish Patent Office for Application No. PA 2014 70712.
"Shell evacuates North Sea platform after power supply problems", Off Shore Energy Today, Aug. 20, 2014, 2 pages.

* cited by examiner

MOBILE OFFSHORE DRILLING UNIT, A METHOD OF USING SUCH A UNIT AND A SYSTEM COMPRISING SUCH A UNIT

RELATED APPLICATIONS

The present application is a continuation of Ser. No. 15/528,626, filed on May 22, 2017, which is a national stage application of PCT/DK2015/000048, filed on Nov. 20, 2015. PCT/DK2015/000048 claims the priority of Danish Patent Application No. PA 2014 70712, which was filed on Nov. 20, 2014. The subject matter of Ser. No. 15/528,626; PCT/DK2015/000048; and PA 2014 70712 is incorporated herein by reference.

TECHNICAL FIELD

The invention generally relates to mobile offshore drilling units. More particular, the invention relates to an offshore system comprising a mobile offshore drilling unit and for performing concurrent well-processing tasks.

BACKGROUND

Mobile offshore drilling units and offshore production platforms are widely used in the exploration and exploitation of hydrocarbon reservoirs under the sea floor.

The various types of mobile offshore drilling units include so-call bottom-supported rigs which rest on the seafloor. Jack-up drilling units are typical examples of bottom-supported units; they comprise a hull and a number of legs adapted to be lowered towards the sea floor. Such jack-up units may thus be towed towards their desired off-shore location with the legs in a raised position. Once the unit is at its intended position the legs are lowered and brought into contact with the sea floor. Further lowering of the legs relative to the hull causes the hull to be elevated out of the water. Many jack-up drilling units have the drill floor and well centre positioned on a cantilever system that can be extended horizontally outwards relative to the hull of the jack-up unit, thus allowing the well centre to be positioned outside the periphery of the unit defined by the hull of the unit.

Offshore production platforms used for extracting oil or gas from a production well are frequently fixedly installed during longer periods. They frequently operate a plurality of wells.

When an oil or gas well is no longer economical or if there is some problem with the well which means that production is no longer possible or that well integrity has been compromised in some way, or for other reasons, the well may be abandoned. It is common practice to plug the well before abandoning it, e.g. to prevent seepage of hydrocarbon product from the well. This can also apply to water injectors, i.e. bores which have been drilled in order to pump water into a reservoir to increase bottom-hole pressure. Similar processes may also be relevant for drilling new wells, or so-called "slot-recovery" where the upper part of the well is re-used by plugging the lower part and side-tracking thus creating a new well using same "slot" on the production platform.

Commonly, plugging may be achieved by injecting a settable substance or medium, e.g. cement, into the well. A well will normally have production perforations, that is to say apertures in a well liner or casing through which hydrocarbon product enters from the rock formation and travels to the surface. During plug and abandonment operations it is common to seal ("squeeze") production perforations with cement or another settable medium which may then form a permanent barrier to prevent flow through the perforations and/or across the zones and potentially out of the well. Alternatively or additionally, at least a part of the downhole equipment, such as casings, production tubing, etc., is often pulled from the well.

The process may further involve pumping mud or other high-density fluids into the well in order to stabilize or "kill the well" and, in particular to provide sufficient pressure so as to prevent carbohydrates from rising out of the well.

The process may further involve pumping a surfactant liquid, known as a "spacer", into the well. The purpose of the spacer is to remove oil residues from the internal surface of the well casing and/or liner and rock matrix making them "water wet" (allowing better adhesion by cement) in addition to limiting cross-contamination between liquids/cement. Commonly, immediately following the spacer, cement is pumped down the well to occupy the part of the well casing and/or liner where perforations are to be squeezed. When sufficient cement has been pumped down, more spacer liquid and possibly other liquids may be pumped down the well in order to place the cement at its final designed location.

The plug and abandonment process may be a complex and costly process, and it is generally desirable to reduce the time required for performing the process, in particular when multiple wells are to be processed at the same site.

WO 2012/144952 discloses a multi-functional jack-up for decommissioning an offshore platform. In particular, this prior art jack-up unit comprises a mobile crane and a tubular-handling crane mounted to a cantilever platform of the jack-up unit and arranged to be operable independently from each other. This prior art jack-up unit aims to introduce flexibility during the well plugging and abandonment by utilizing the multifunctional jack up as a tender assist vessel which assists the offshore platform during the plugging and abandonment operation. In addition to providing assistance to the offshore platform, the multifunctional jack-up is able to perform decommissioning of the offshore platform itself.

However, it remains desirable to further improve the efficiency of the plug and abandonment process or similar processes performed on multiple wells.

SUMMARY

According to a first aspect, disclosed herein are embodiments of an offshore well-processing system for performing one or more well-processing tasks on one or more wells of an off-shore oil or gas reservoir. Embodiments of the system comprise a mobile offshore drilling unit and a remote well-processing device. The mobile offshore drilling unit defines at least one well centre and comprises at least one primary drill rig comprising at least one drill floor and at least one hoisting system for raising and/or lowering tubular equipment through the at least one well centre from and/or into a well in the seafloor.

The remote well-processing device is configured to be positioned on an offshore platform different from the mobile offshore drilling unit, and to perform at least a first well-processing task when positioned on said offshore platform at a position displaced from the at least one well centre defined by the mobile offshore drilling unit. The mobile offshore drilling unit and the remote well-processing device are configured to be operationally coupled to each other when the remote well-processing device is positioned on said offshore platform; and the mobile offshore drilling unit is configured to assist in performing two or more concurrent well-processing tasks performed concurrently on respective wells, including the first well-processing task performed by the remote well-processing device on a first well and a second well-processing task concurrently performed by the offshore well-processing system on a second well.

Hence, embodiments of the well-processing system described herein allow plug and abandonment process or other well-processes to be performed in an efficient manner as multiple wells may be processed concurrently and independently of each other. In particular, the remote well-processing device may be moved from well to well and perform one or more first well-processing tasks while the drill rig of the mobile offshore drilling unit and/or another remote well-processing device may concurrently, i.e. parallel in time, be moved from well to well and perform one or more second well-processing tasks. Consequently, a batch processing of multiple wells may be performed where certain tasks may be moved away from the critical path of the overall process, thus speeding up the overall process.

The first well-processing task may be different from the second well-processing tasks and may require different types of equipment. Hence, the remote well-processing device may be specifically configured to perform a selected set of one or more first well-processing tasks while the drill rig of the mobile offshore drilling unit or a second remote well-processing device may be specifically configured to perform the one or more second well-processing task. For example, the drill rig may perform tasks that require a high lifting capacity and/or high torque to be imparted on a string of tubular and/or a high-throughput pipe handling; while a lower-rated remote well-processing device may perform tasks that do not require the heavy and efficient equipment of a drill rig.

Consequently, the well-processing tasks may be performed on multiple wells in parallel and by equipment specifically configured for the respective tasks, thus allowing for a more efficient overall utilisation of the equipment.

The first and second well-processing tasks may be respective sub-tasks of a process. In some embodiments the first and the second well-processing tasks are each to be performed on multiple wells, e.g. on all wells associated with the offshore platform. In some embodiments, they even have to be performed in a predetermined sequence, e.g. the second well-processing task before the first well-processing task or vice versa. In other embodiments, the first and/or the second well-processing task may only need to be performed on one or some, but not on all wells. For example, some wells may only require the first well-processing task while some wells may only require the second well-processing task to be performed.

Generally, the mobile offshore drilling unit may comprise one or more drill rigs, each comprising a drill floor defining a well centre. Alternatively or additionally, the mobile offshore drilling unit may comprise a multi-activity drill rig, such as a dual-activity drill ring, defining two or more well centers and comprising one, two or more hoisting systems for raising or lowering tubulars through the respective well centres. In any event, the remote well-processing device is configured to be positioned independently from, and at a position different from, the position of the well centre(s) defined by any drill rig mounted on the mobile offshore drilling unit. As the remote well-processing device may be positioned above respective wells independently of the positioning of the drill rig, re-positioning of the remote well-processing device may be performed efficiently and without necessarily requiring cantilever operations of the mobile offshore drilling unit.

Embodiments of the drill rig of the mobile offshore drilling unit may comprise a derrick, a tower, a mast or another suitable drilling support structure. The hoisting system may be a drawworks based hoisting system, a hydraulic hoisting system or another suitable type of hoisting system. The hoisting system of the mobile offshore drilling unit may have a rated capacity sufficiently high to allow raising tubular equipment, such as production tubing or casing, out of a well. The drill rig may comprise a top drive or another suitable device for imparting sufficient torque on a drill string that extends into a wellbore for performing drilling or similar operations.

In some embodiments, the mobile offshore drilling unit comprises a mud handling system including one or more mud pumps and a manifold allowing mud or other well fluids to be pumped into the well, out of the well or circulated in and out of the well. The mobile offshore system may further comprise a blow-out-preventer which may be located below the drill floor.

As the mobile offshore drilling unit is operationally coupled to the remote well-processing device, the remote-well processing device utilises one, some or all of the facilities of the mobile offshore unit, such as power, pumping capacity, pipe handling capacity, process control equipment etc. These facilities thus perform one or more auxiliary functions. Assisting in performing a well-processing task is thus intended to comprise supplying one or more auxiliary functions that facilitate the performance of the well-processing task. The actual well-processing task may also be performed by the mobile offshore drilling unit; alternatively the actual well-processing task may be performed by a device that may be positioned on, and be structurally supported by, the offshore platform. In particular, assisting in performing a well-processing task may include performing one or more auxiliary functions that may be performed remotely from the well head, e.g. horizontally displaced from the well-centre and/or vertically displaced from a well head located on the offshore platform. In some embodiments, the horizontal and/or vertical displacement may be more than 2 m, such as more than 5 m away, such as more than 10 m. To this end, the equipment of the mobile offshore drilling unit that provides the auxiliary function is connected to the device positioned at or above the well head via the operational coupling, e.g. a supply line and/or a communication line and/or flow line.

Consequently, the offshore platform on which the remote well-processing device is placed needs to be able to provide structural support only to the remote well-processing device while further auxiliary equipment assisting the remote well-processing device in the operation performed by the remote well-processing device is structurally supported by the mobile offshore drilling unit. Moreover, such auxiliary equipment may require considerable space which may be available on the mobile offshore drilling unit while the offshore platform may not have sufficient free space available for accommodating the auxiliary equipment. Examples of such auxiliary equipment may include pumps and/or pits and/or mixing devices and/or manifolds for mud, cement and/or other fluid media, devices for storing and/or processing and/or controlling solids, drums/reels for coiled tubing, etc.

To this end, in some embodiments, the operational coupling comprises at least one connection chosen from:

One or more utility lines for transferring power, such as electrical power and/or hydraulic power, from the mobile offshore drilling unit to the remote well-processing device, One or more communication lines for transferring communications signals, such as control signals, sensor signals, alarm signals, etc., between the remote well-processing device and the mobile offshore drilling unit, and One or more flow lines for transferring well fluids, such as mud or cement, between the remote well-processing device and the mobile offshore drilling unit.

For example the power and communication lines may be provided as one or more umbilical cables between the mobile offshore drilling unit and the remote well-processing device.

The mobile offshore drilling unit may comprise a pipe setback associated with the primary drilling rig and/or other pipe handling apparatus for handling pipes on the drill floor or off the drill floor. Off-drill-floor pipe handling may include all pipe handling for moving tubulars to/from the drill floor as well as all pipe handling other than connecting the pipes to the hoisting system and/or to an existing string of tubulars and other than alignment of the pipes with the hoisting system and the well centre.

In some embodiments, the system comprises a pipe transfer apparatus configured to transport tubulars between the mobile offshore drilling unit and the remote well-processing device when said remote well-processing device is positioned on said offshore platform. The pipe transfer apparatus may comprise a pipe handling apparatus and/or a catwalk machine, a chute, a crane, or similar pipe transport apparatus for transporting pipes across the offshore platform and/or between the offshore platform and the mobile offshore drilling unit. The pipe transport apparatus may be configured to transport individual pipes and/or multiple pipes at the same time. Once tubulars are transferred to the mobile offshore drilling unit, the pipe handling and/or storage facilities of the mobile offshore drilling unit may be utilised for efficient handling and storage of pipes.

In some embodiments, the mobile offshore drilling unit comprises a pump system including one or more pumps for transferring fluids such as mud, chemicals, cement between the mobile offshore drilling unit and a well; wherein the remote well-processing device is connectable to said pump system via a flow line. The remote well-processing device may further be connectable to a conductor extending from the offshore platform to the first well. In some embodiments the mobile offshore drilling unit comprises a pump system configured to selectively or concurrently transfer fluids between the mobile offshore drilling unit and the first well via the remote well-processing device and between the mobile offshore drilling unit and the second well via the primary rig. More particular, in some embodiments, the mobile offshore drilling unit comprises a first manifold connected to the pump system and operable to facilitate pumping fluids, such as mud or other well fluids, into or out of the second well via the primary drill rig, e.g. through a conductor extending from the offshore platform or from the mobile offshore drilling unit to the second well; and wherein the mobile offshore drilling unit comprises a second manifold connected to the pump system and operable to facilitate pumping fluids into or out of the first well through said flow line and a conductor extending from the offshore platform to the first well. Hence, the control of transferring fluids between the mobile offshore drilling unit and multiple wells, selectively via the remote well-processing device, may be performed in an efficient manner.

The mobile offshore drilling unit and the offshore platform are each configured to be positioned relative to the seafloor independently of each other and with a gap between them. In particular, they may each be configured to support the weight of equipment positioned on them. Hence, the offshore platform only needs to support the weight of the remote well-processing device, while the drill rig, mud and/or cement and/or other pumps, energy, pipe handling and storage capacity is provided by the mobile offshore drilling unit. The mobile offshore drilling unit, the offshore platform, or both may be bottom-supported.

In some embodiments the offshore platform is a production platform, e.g. with facilities to extract and process oil and natural gas, and to temporarily store product until it can be brought to shore for refining and marketing. The production platform may be a production platform with dry well heads. In many cases, the platform contains facilities to house the workforce as well. Depending on the circumstances, the offshore platform may be fixed to the sea floor, e.g. by a jacket, may consist of an artificial island, may be a compliant tower, or may otherwise float. The production platform may operate on a plurality of wells e.g. arranged in a grid of wells. From each well, a conductor pipe may extend between the production platform and the seafloor.

The mobile offshore drilling unit and/or the offshore platform may comprise accommodation for personnel.

In some embodiments, the mobile offshore drilling unit is configured to stand on the sea floor, to float in the water, to perform drilling operation while floating and being moored and/or to perform drilling operations while resting on the seafloor. In some embodiments the mobile offshore drilling unit is a jack-up unit or a semi-submersible unit or a drillship. A jack-up unit is a floatable, self-elevating platform which is bottom-supported by legs. In some embodiments, the mobile offshore drilling unit comprises a cantilever mounted on the unit. The primary drill rig including the drill floor is mounted on a drill operation end of the cantilever. The cantilever mat be arranged to allow two-dimensional movement of the primary drill rig. The cantilever may be moveable in a longitudinal direction of the cantilever such that the drill operation end of the cantilever extends beyond the platform, whilst the drill floor may be moveable on the cantilever in a direction transverse to the longitudinal direction. Hence, the cantilever may allow the well center of the primary drill rig to be located within an area described by the longitudinal and transverse movement of the cantilever and/or the drill rig. When the mobile offshore drilling unit is configured to extend the cantilever above the offshore platform, the well centre of the primary drill rig may be positioned above selected wells associated with an existing offshore production platform. The cantilever may provide a counterweight to the cantilever such that the cantilever can extend above the offshore platform without resting the cantilever on the offshore platform. In some embodiments, the first well-processing task and/or the second well processing task is/are performed on a well that is positioned outside a perimeter defined by the cantilever, i.e. on a well that is not positioned underneath the cantilever. In some embodiments, only the first well-processing task is performed (e.g. by the remote well-processing device) on a well that is positioned outside a perimeter defined by the cantilever, while the second well-processing task is performed on a well above which the cantilever extends.

In some embodiments, the offshore mobile drilling unit transports the remote well-processing device, e.g. in assembled form or as several modules, to an existing offshore platform and positions the remote well-processing device—or modules of the device—on the offshore platform. The transfer may be performed by a crane of the mobile offshore drilling unit or the offshore platform. Alternatively or additionally, in some embodiments, the mobile offshore drilling unit is configured to attach at least a part of the remote well-processing device to the cantilever and to position at least the part of the remote well-processing device onto the offshore platform. Hence, the cantilever may be operable to carry and position a relatively large structure in one piece on the offshore platform. To this end, the cantilever may comprise connectors—e.g. hooks, beams, or the like, for detachably connecting and carrying the remote well-processing device or one or more modules thereof.

The connectors may be positioned at the longitudinal end of the cantilever extending away from the hull. Alternatively, the connectors may be positioned along the lateral sides of the cantilever e.g. so that the remote well-processing device, when connected to the cantilever, does not substantially extend the dimensions of the mobile offshore drilling unit during transit. It may sit over or on the main deck when the cantilever is retracted so as to allow maintenance and/or configuration of the remote well-processing device, e.g. during transit.

Alternatively, or in combination, the remote well-processing device may be assembled on the offshore platform. Optionally the remote well-processing device may remain on the platform for further operations when the mobile offshore drilling unit is moved away or to be ready for a later operation in conjunction with the same or another mobile offshore drilling unit. This may require the addition of utilities to the offshore platform and/or connections to the systems existing on the offshore platform if any.

In some embodiments, the offshore platform may comprise a first well-processing device and the offshore mobile drilling unit may transport a further well-processing device, e.g. a drill rig, a mast, and/or the like, to the offshore platform and position the further well-processing device—or modules of the device—on the offshore platform. The offshore mobile drilling unit may then be operationally coupled to one or both of the first well-processing device and the further well-processing device so as to assist one or both of the well-processing devices in performing the respective well-processing tasks performed by the respective well-processing devices.

The remote well-processing device may be configured to perform a single type of tasks or a variety of tasks. Accordingly, the remote well-processing device may range from relatively simple equipment to a complex drill rig with its own hoisting system and top drive.

Some embodiments of the remote well-processing device comprises one or more of

- a connector or manifold for connecting a flow line extending from a pump of the mobile offshore drilling unit to a conductor extending from the offshore platform to the seafloor;
- a working platform;
- a hang-off device (e.g. slips or a rotary table) suitable for hanging off tubulars such as drill pipe and/or casings;
- a device for wireline operations into the first well, e.g. including sheaves to guide the wireline into the hole. The wireline may be spooled on a spool placed on the offshore platform, on the remote well-processing device, on the mobile offshore drilling unit such as on the main deck or a Texas deck of the mobile offshore drilling unit;
- a device, e.g. a coiled tubing injector, for coiled tubing operation into the first well; the tubing may be spooled on a spool/reel placed on the offshore platform, on the remote well-processing device, on the mobile offshore drilling unit such as on the main deck or a Texas deck of the mobile offshore drilling unit;
- a blow-out-preventer (BOP), such as an annular BOP arranged to seal around a wireline, coil tubing, drill pipe or other tubular, one, two or more shear rams suitable for cutting the tubular in the hole, such as wireline, coil tubing, drill pipe and/or casing; the BOP may have a pressure rating below 3000 PSI or between 3000 and 7000 PSI (such as 5000 PSI), between 7000 and 13000 PSI (such as 10000 PSI), or 12000 and 18000 PSI (such as 15000 PSI) or 18000 and 22000 PSI (such as 20000 PSI);
- a drilling support structure arranged to support hoisting in and/or out of the hole, such as a derrick, a tower or a mast; for example a mast or derrick 10 ft or higher relative to a work platform, such as 20 ft or higher, such as 30 ft or higher, such as 40 ft or higher, such as 50 ft or higher, such 60 ft or higher, such 70 ft or higher, such as 80 ft or higher;
- a hoisting system, such as a drawworks based hoisting system or a hydraulic hoisting system;
- break-out tongs and/or shearing devices;
- a control system and cabin for controlling a well-processing task in the second well;
- a top drive.

For example, in one embodiment the remote well-processing device merely comprises a device for transferring cement and/or mud and/or other well fluids into or out of a well. To this end, the remote well-processing device may comprise a connector or manifold for connecting a flow line extending from a pump of the mobile offshore drilling unit to a conductor extending from the offshore platform to the seafloor.

When the remote-processing device further comprises a working platform, personnel may easily access the connector and/or manifold and/or other equipment of the remote well-processing device.

When the remote well-processing device further comprises a device for wireline operation and/or coiled tubing operation, the remote well-processing device may further perform monitoring and testing operations and/or other operations that do not require the handling of pipes. In some embodiments, a reel or drum for accommodating a wireline or coiled tubing may be positioned on the mobile offshore drilling unit and be fed from said drum to a well-processing device on the offshore platform which well-processing device is configured to advance the wireline or coiled tubing into the well.

Alternatively or additionally, when the remote-processing device comprises a hoisting system, the remote well-processing device may also be used to pull equipment e.g. production tubing from the well. To this end the remote-processing device may further comprise pipe-handling equipment, break-out tongues and/or shearing devices and/or a blow-out preventer (BOP), such as a wireline BOP or stripping BOP. Nevertheless, in some embodiments, a pipe transfer apparatus and on- and/or off-drill-floor pipe handling apparatus of the mobile offshore drilling unit may perform some or even all off-drill-floor pipe handling associated with the first well-processing task performed by the remote well-processing device. In some embodiments, the pipe handling may be assisted by a crane of the offshore platform.

In some embodiments, the remote-processing device may even comprise a top drive.

In any event, the type of the equipment, its rated capacity and capabilities may be adapted to the nature of the well-processing tasks to be performed by the remote well-processing device. In some embodiments, the remote well-processing device has a lower rated lift capacity and/or a lower rated torque capacity and/or a lower pipe handling throughput capacity as the primary drill rig.

The remote well-processing device may be movable between well locations. It will be appreciated that the mechanism for moving the remote well-processing device may depend on the size and type of the device. In some embodiments, the remote well-processing device is arranged skiddable on the offshore platform, e.g. on one or more skid beams traversing a grid of well slots and supported by skid beams extending along said grid, or fitted on one or more trolleys for parallel movement; and/or via other forms of skid beams, tracks and/or the like; and/or by means of wheels on the remote well-processing device.

In some embodiments, the system may comprise multiple remote well-processing devices, each configured to perform one or more well-processing tasks (e.g. respective sub-tasks of a sequence of sub-tasks) when positioned on said offshore platform at respective positions displaced from each other and from the at least one well centre defined by the mobile offshore drilling unit; and wherein the mobile offshore drilling unit is configured to be operationally coupled (e.g. by respective flow lines, utility lines, communications lines and/or the like, as described herein) to each of the remote well-processing devices when the respective remote well-processing devices are positioned on said offshore platform; and wherein the mobile offshore drilling unit is configured to assist in performing concurrent well-processing tasks performed concurrently on respective wells, including a first well-processing task performed by a first remote well-processing device on a first well and a second well-processing task concurrently performed by a second remote well-processing device on a second well. The remote well-processing devices may each have the same capability and equipment or they may have different capabilities and equipment, e.g. so as to tailor respective remote well-processing devices for respective specific well-processing tasks. Additionally or alternatively, the remote well-processing device and/or the primary drilling rig may be configured to operate concurrently on multiple wells. Hence, generally embodiments of the system described herein is configured to perform two or more concurrent well-processing tasks on respective two or more wells; wherein at least one task is performed by the remote well-processing device and another task is concurrently performed by a remote well-processing device or the primary drilling rig.

The present disclosure relates to different aspects including the system described above and in the following, corresponding methods, devices, and/or product means, each yielding one or more of the benefits and advantages described in connection with the first mentioned aspect, and each having one or more embodiments with all or just the additional features corresponding to the embodiments described in connection with the first-mentioned aspect and/or disclosed in the appended claims.

According to yet another aspect, disclosed herein are embodiments of a method of performing one or more well-processing tasks on one or more wells of an offshore oil or gas reservoir, the method comprising:

positioning a mobile offshore drilling in a proximity of an offshore platform different from the mobile offshore drilling unit and located above a plurality of wells, the mobile offshore drilling unit comprising a primary drill rig comprising a drill floor and a hoisting system for raising and lowering tubular equipment from/into a well in the seafloor;

performing, at a position on the offshore platform and displaced from a well centre defined by the mobile offshore drilling unit a first well-processing task on a first well, assisted by the mobile offshore drilling unit via an operational coupling extending between the mobile offshore drilling unit and said position on the offshore platform; and concurrently performing a second well-processing task on a second well, by the mobile offshore unit or assisted by the mobile offshore drilling unit via an operational coupling extending between the mobile offshore drilling unit and a position of the second well on the offshore platform.

In some embodiments, the method comprises:

providing a remote well-processing device;

positioning the remote well-processing device on said offshore platform different from the mobile offshore drilling unit at a position displaced from a well centre defined by the mobile offshore drilling unit;

operationally coupling the remote well-processing device to the mobile offshore drilling unit;

performing, by the remote well-processing device positioned on the offshore platform, a first well-processing task on a first well, assisted by the mobile offshore drilling unit via said operational coupling; and concurrently performing a second well-processing task on a second well, by the mobile offshore unit or assisted by the mobile offshore drilling unit via an operational coupling extending between the mobile offshore drilling unit and a position of the second well on the offshore platform.

The well-processing tasks may be respective sub-tasks of a decommissioning task and, in particular, a plug and abandoning task including stabilizing or "killing" and sealing a well in preparation for temporarily or permanent abandonment. In some embodiments, the well-processing tasks may be sub-tasks of the process of drilling new wells, or of a so-called "slot-recovery" process where the upper part of a well is re-used by plugging the lower part and by side-tracking, thus creating a new well using an existing "slot" on the production platform.

In some embodiments, the first well-processing task comprises one or more of: killing a well, sealing, logging, testing and/or monitoring tasks in the well, and/or the like. Killing the well may comprise injecting a fluid or medium, e.g. mud, into the well, where the fluid or medium has a density sufficiently high to create a pressure high enough to prevent oil or gas from exiting the well. Sealing the well may comprise injecting a settable substance or medium, e.g. cement, into the well. Sealing may further comprise injecting other chemicals such as a spacer. Testing and monitoring tasks may include lowering a wireline or coiled tubing into the well.

In some embodiments, the second well-processing task comprises one or more of: pulling production tubing from a well, removing casing from a well, drilling a side track, milling, logging, and/or the like. These tasks may require a relatively high lifting capacity and/or torque and may thus advantageously be performed by a drilling rig or by a remote processing unit having a sufficient lift and/or torque rating.

It will be appreciated, that other divisions of the first and second well-processing tasks between the remote well-processing device and the primary drill rig or another remote well-processing device may be used. For example, some of the killing, sealing, and monitoring tasks may be performed by the drill rig, while only one or some of the killing, sealing and monitoring operation is performed by the remote well-processing device.

In some embodiments, the well-processing tasks may be respective sub-tasks of a drilling and completion task.

Generally, when a remote well-processing device assisted by a mobile offshore drilling unit performs concurrent operations (e.g. in parallel to operations performed by another remote well-processing device and/or by the mobile offshore drilling unit), this may take time off the critical path of the mobile offshore drilling unit for operations that would otherwise have to be performed by the mobile offshore drilling unit. A well processing task typically comprises sub-tasks that only impose relatively few requirements on the equipment while others impose many requirements. Accordingly, the selection of which sub-tasks may advantageously be performed by a remote well-processing device of the offshore platform and merely assisted by the mobile offshore drilling unit and which sub-tasks are rather performed by the mobile offshore drilling unit depends on the available space, structural support and facilities available on the offshore drilling unit, and by the requirements imposed on the remote-well processing device that is present or positioned on the offshore platform. For example, if a full BOP stack is installed at the remote well-processing device, the remote well-processing device may run and pull tubing, perform scraper run and/or possibly mill and drill tasks. This may be applicable for a remote well-processing device configured to perform plug and abandonment operations or for a remote well-processing device configured to perform well construction/completion tasks. Even without having a full BOP stack installed, a remote well-processing device may perform tasks such as slickline, wireline and coil tubing operations and other minor handling jobs.

In some embodiments, the well processing task comprises a drilling and completion task that comprises multiple sub-tasks. Some sub-tasks, such as slickline completion tasks, x-mas tree tasks and/or post-completion jobs, only require e.g. a slickline drum, sheaves, a crane, a pump. Some or all of these sub-tasks may thus be performed by a relatively simple remote well-processing device and assisted by the mobile offshore drilling unit. As these tasks are typically performed at the final stages of a drilling and completion task, these may be performed by a remote well-processing device after some or all the previous sub-tasks of the drilling and completion task have been performed by a mobile offshore drilling unit. Some or all of these sub-tasks may thus be performed by relatively simple a remote well-processing device and assisted by the mobile offshore drilling unit. Concurrently, the mobile offshore drilling unit may be used to perform other subtasks, e.g. drilling tasks, on another well.

Another group of subtasks of a drilling and completion task include the running and pulling of tubing. These sub-tasks may require one or more of the following: a mast, a topdrive and/or power swivel, a rotary table, fluid circulation, a control system, a BOP and associated control system, a manifold and pipe handling equipment. Some or all of these sub-tasks may thus be performed by a remote well-processing device and assisted by the mobile offshore drilling unit. In such an embodiment, the remote well-processing device may thus comprise one or more of the following: a mast, a BOP, a topdrive, power swivel or similar device for imparting torque, a rotary table.

Yet another group of subtasks of a drilling and completion task include the running and pulling of drill pipe. These sub-tasks may further require an increased hoisting capacity and increased torque, pipe storage and handling facilities. Some or all of these sub-tasks may thus still be performed by a remote well-processing device and assisted by the mobile offshore drilling unit, provided that the remote well-processing device has sufficiently rated hoisting equipment. Nevertheless, in some embodiments, these sub-tasks may advantageously be performed by a mobile offshore drilling unit.

Finally, yet another group of subtasks of a drilling and completion task includes the drilling, running casing and cementing of a top/surface section and of one or more intermediate sections of the well and the drilling of a reservoir section of a well. These sub-tasks may further require solids control, additional pumps and sufficient pit space. Some or all of these sub-tasks may thus still be performed by a remote well-processing device and assisted by the mobile offshore drilling unit, provided that the remote well-processing device has sufficiently rated hoisting equipment. Nevertheless, in some embodiments, these sub-tasks may advantageously be performed by a mobile offshore drilling unit.

In some embodiments, the first and/or the second well processing task may be a task requiring a BOP. In such an embodiment, it may be particularly advantageous for the mud handling functionality to be performed on and by the mobile offshore drilling unit, as the operation of mud pits, mud pumps and mixing equipment requires considerable space. Hence, in some embodiments, the offshore drilling unit assists in a well-processing task that requires operation of a BOP by providing one or more facilities chosen from the following: a mud pump, a mud pit, mud mixing equipment, equipment for controlling solids.

In some embodiments, the offshore drilling unit assists in a well-processing task that requires operation of a BOP by further providing one or more facilities chosen from the following: a choke-and-kill manifold, a standpipe manifold, a cement manifold. However, in alternative embodiments, one, some or all of these functions may be provided by equipment of or on the offshore platform. In some embodiments, when a well-processing task requiring a BOP is performed by a well-processing device positioned on the offshore platform, a trip tank or other well monitoring equipment may be provided on the offshore platform.

According to yet another aspect, disclosed herein is a mobile offshore drilling unit comprising a primary drill rig comprising a drill floor and a hoisting system for raising and lowering tubular equipment from/into a well in the seafloor through a well centre defined by the mobile offshore drilling unit; and wherein the mobile offshore drilling unit is configured to establish an operational coupling with a remote well-processing device positioned on an offshore platform different from the mobile offshore drilling unit and at a position different from the well centre defined by the mobile offshore drilling unit; and to assist in performing two or more concurrent well-processing tasks performed on respective wells of an offshore oil or gas reservoir; wherein at least a first one of said well-processing tasks is performed by said remote well-processing device.

The cantilever may further comprise a hoisting system supported by a drilling support structure, such as a mast or derrick, extending upwards from the cantilever. The hoisting system is configured to raise and lower tubulars through the well centre and from/to the seabed. The drilling rig may further comprise a top drive or other device operable to rotate the tubulars that are lowered or raised through the well centre.

BRIEF DESCRIPTION OF THE DRAWINGS

The above and/or additional objects, features and advantages of embodiments and aspects of the present invention, will be further elucidated by the following illustrative and non-limiting detailed description with reference to the appended drawings, wherein.

DETAILED DESCRIPTION

In the following description, reference is made to the accompanying figures, which show by way of illustration how the invention may be practiced.

Figure 1:
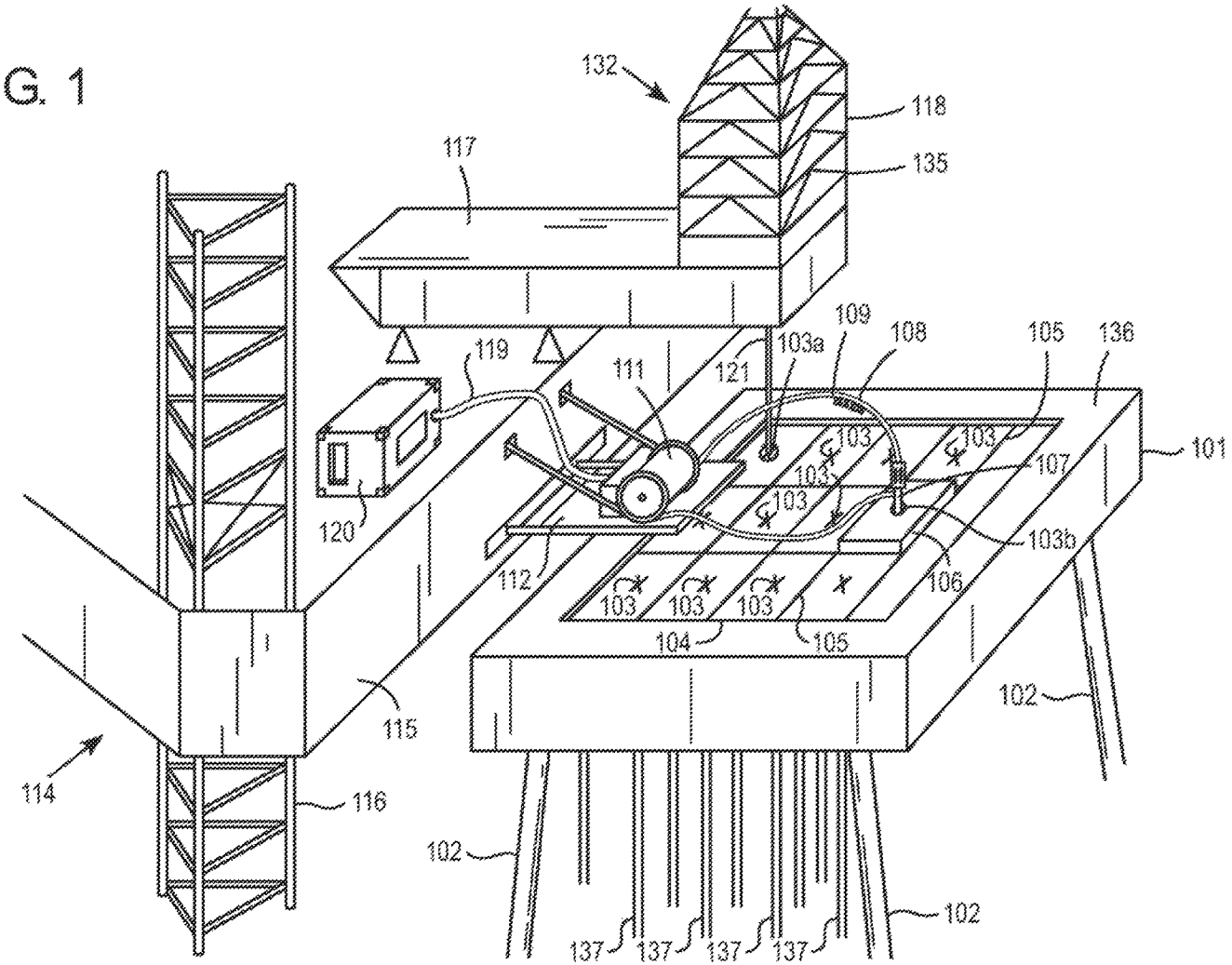
FIG. 1 schematically illustrates an example of an off-shore well-processing system.

FIG. 1 schematically illustrates an example of an off-shore well-processing system. In particular, shows a mobile offshore jack-up drilling unit 114 positioned adjacent an oil production platform 101. The jack-up unit includes a floatable platform having a hull 115, a number of legs 116 and a cantilever 117 which allows a drill rig 132 to be skidded so that the position of the well centre can be moved horizontally. In particular, the cantilever 117 can be skidded such that it extends horizontally outside the periphery of the hull. The legs 116 are in this embodiment placed substantially in each corner of the unit and extend through the hull. The drill rig comprises the drill floor 135 from which drilling operations are conducted. A hole in the drill floor, e.g. in the form of a rotary table, defines the well centre though which drilling operations can be performed. Typically, a diverter system is installed below the rotary table for closing the vertical passage through the pipes and for directing the flow of well fluids away from the drill floor. The drilling rig further comprises a drilling support structure 118, such as a mast or derrick, which extends upwardly from the cantilever and which supports a hoisting system. The hoisting system comprises a hook or similar device from which a string of tubulars 121 may be suspended and lowered and raised through the well centre. To this end, the hoisting system may comprise a top drive to which an upper end of the drill string may be connected and which may impart torque on the drill string.

The drill rig 132 is configured to perform drilling or other well-processing operations, e.g. through a BOP stack installed below or inside the cantilever and through a conductor pipe extending from the BOP stack downwards towards the seabed.

The offshore production platform 101 is configured for production of oil or gas offshore. The offshore platform 101 of FIG. 1 is a fixed platform and comprises a superstructure supported by a jacket 102. The jacket comprises tubular members interconnected together to form a 3-dimensional frame including a number of jacket legs. The jacket is anchored to the seabed to provide stability against overturning moment caused by waves or extreme weather conditions. The superstructure normally includes a few levels and includes a skid deck 136. The offshore platform also includes conductor pipes 137 set in the seabed to provide foundations for a wellhead. The conductor pipes are configured to provide passage for drilling fluid and drill string to be lowered down into the wells and the fluid and cuttings to flow back to the rig as well as to prevent formations near the well from caving into the wellbore.

For example, an offshore platform may have a grid of several well slots 103. These well slots may be located between skid beams 104.

The offshore well-processing system of FIG. 1 further comprises a remote well-processing device 106 that is movably positioned on offshore platform so as to be repositioned above respective well slots 103. In order to cover the whole well slot area, the remote well-processing device 106 may be equipped with skidding jacks 105. These skidding jacks are latched onto the skid beams and enable the remote well-processing device to skid from one well slot to the other well slots. In the example of FIG. 1, the remote well-processing device is currently positioned over one of the well slots 103*b*. Alternatively, the remote well-processing device 106 may be moved between well slots in a different manner, e.g. by an on-deck crane of the jack-up unit or the offshore platform 101.

The offshore jack-up rig 114 is positioned adjacent the existing fixed offshore platform which serves as a grid, over which the cantilever 117 of the jack-unit is extended. The offshore platform remains at some distance from the jack-up unit such that a gap exists between the two structures. While the jack-up unit is positioned next to the existing offshore platform, no weight is transferred between the jack-up unit and the offshore platform, other than placement of the remote well-processing device 106 on the offshore platform.

The cantilever is extended above the existing platform 101 such that the well centre defined by the drill floor 135 of the drill rig is positioned above one of the well slots 103*a* and such that the drill rig can raise or lower a string of tubulars 121 from or into the well 103*a*, e.g. so as to pull production tubing or casings from a well. The pipes or other tubulars may then be efficiently handled by pipe handling apparatus of the jack-up unit (not explicitly shown in FIG. 1) and stored on pipe storage areas of the jack-up unit. Concurrently with the operation performed on well 103*a* by the drill rig of the jack-up unit, the remote well-processing device 106 can perform another well-processing operation on another well 103*b*. In the example of FIG. 1, the remote well-processing device 106 comprises a skiddable platform having a hole through which coiled tubing 109 may be run into the well 103*b*. To this end, the remote well-processing device comprises a coiled-tubing injector 107. The coiled tubing injector may include one or more of the following: a gooseneck or guide-arch 108, and injector drive motor, a stripper assembly, a coiled-tubing BOP, an injector-head break system, an injector-head chain assembly.

The jack-up unit 114 assists the remote well-processing device 106 in performing the coiled tube operation. In particular, in the example of FIG. 1, a coiled tubing reel 111 is positioned on a deck 112 attached to and extending from the hull 115 of the jack-op unit. And from a power-supply and control unit 120 placed on the main deck of the jack-up unit. The control and power-supply unit 120 is connected to the reel 111 by power and control lines 119 and the coiled-tubing injector 107 is connected to the power and control unit 120 via power and control lines 110, in this example via the reel. The coiled tubing extends from the reel 111 to the gooseneck 108 of the injector 107 and from there downwards through the injector into the well 103*b*.

It will be appreciated that, in alternative embodiments, the reel and/or other parts of the coiled tubing equipment may be placed n the production platform and/or on other parts of the jack-up unit. Moreover, alternative embodiments of a system may include one or more further remote well-processing devices which may each be positioned above respective well centres 103 and which may each perform respective tasks.

Hence, FIG. 1 illustrates an example of a system where a well-processing task—in this example a coiled tubing operation—is in progress at a remote well-processing device defining a secondary well centre 103*b*, but where the mobile offshore drilling unit, or equipment positioned on-board the mobile offshore drilling unit, assists the remote well-processing device in performing the well operation task. In particular, in the example of FIG. 1, the coiled tubing reel, controls and power are all provided by the mobile offshore drilling unit or by equipment positioned on-board the mobile offshore drilling unit. Hence, a primary operation is performed on one well entirely by the drilling rig 132 of the mobile offshore drilling unit, while a parallel, secondary operation is performed by the remote well-processing device on the platform which provides structural support to the remote well-processing device, but where the secondary operation is otherwise assisted/facilitated by equipment on-board the mobile offshore drilling unit.

It will be appreciated that, in addition or alternative to coiled tubing operation, a remote well-processing device may be configured to perform another type of secondary process, such as logging operation, a wireline operation, a pumping operation, e.g. for killing a well, and/or the like.

Figure 2:
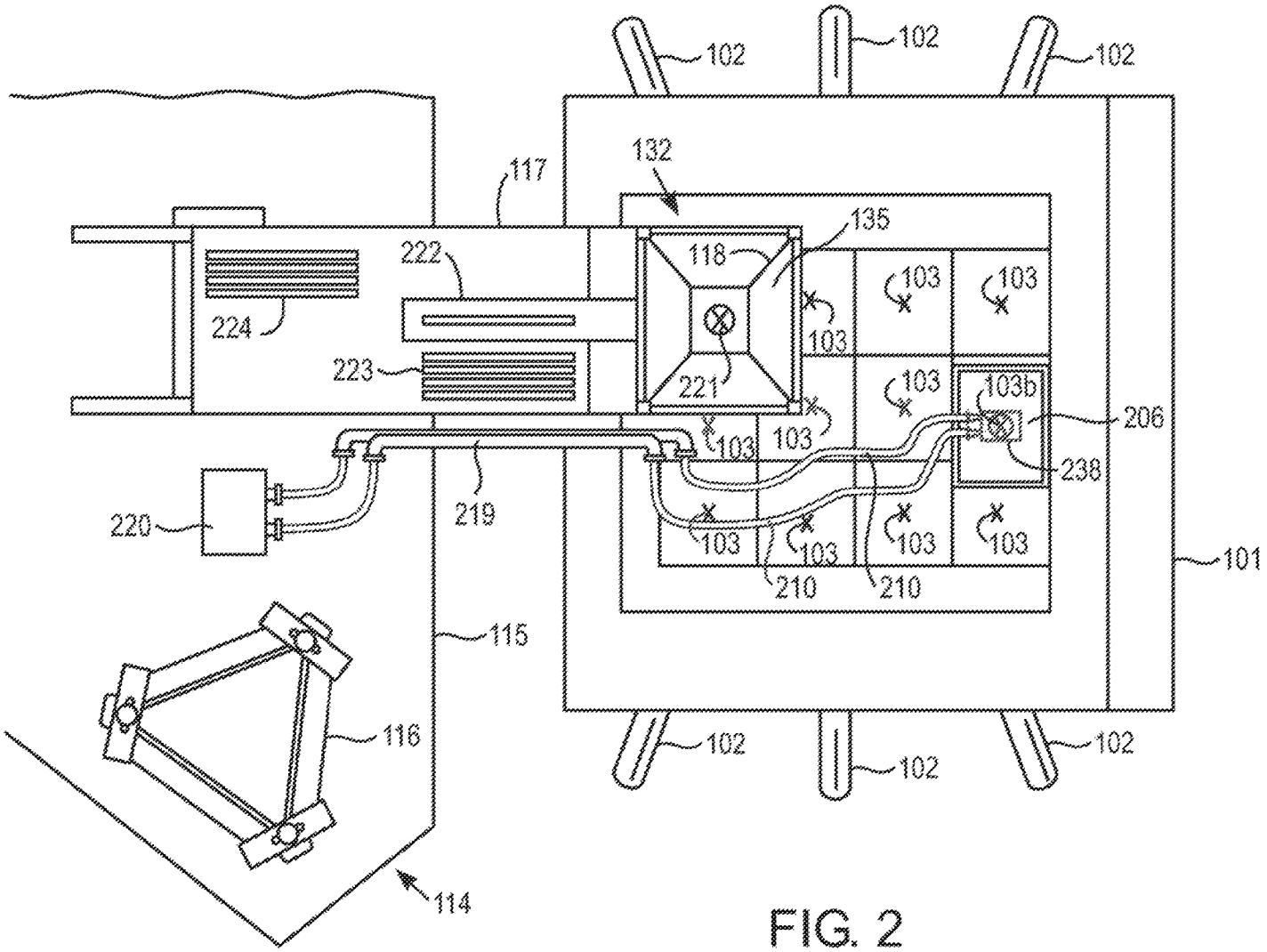
FIG. 2 schematically illustrates another example of an off-shore well-processing system.

FIG. 2 schematically illustrates another example of an off-shore well-processing system. In particular, shows a top view of a mobile offshore jack-up drilling unit 114 positioned adjacent an oil production platform 101 as described above. The features of the jack-up unit that have already been described in detail in connection with FIG. 1 will not be described in detail again, but they are referred to by the same reference numerals as in FIG. 1.

As in the example of FIG. 1, the drill rig of the jack-up unit comprises the drill floor from which drilling operations are conducted. A hole in the drill floor, e.g. in the form of a rotary table, defines the well centre 221 through which drilling operations can be performed.

FIG. 2 further shows an example of a pipe handling apparatus 222, such as a catwalk machine for transferring pipes or other tubulars between a pipe storage area 223 and the drill floor of the drill rig 132. The jack-up unit may provide additional pipe storage areas, e.g. a pipe storage area 224 and/or at other locations of the unit. Hence, some or even all pipe handling may be performed by pipe handling equipment of the jack-up unit.

As in the example of FIG. 1, the system of FIG. 2 also comprises a remote well-processing device 206 which is shown positioned on the offshore platform 101 above a well slot 103*b* but which may be repositioned to other well slots 103, e.g. as described in connection with FIG. 1. In the example of FIG. 2, the remote well-processing device 206 comprise a work platform and a fluid interface 238 which can be coupled to a conductor pipe and through which mud or cement can be pumped into or out of a well. The fluid interface may further comprise a blow-out preventer. The fluid interface 238 is connected by flow lines 210, and 219 to a pump station 220 located on the jack-up unit, e.g. a mud pump or a cement pump station.

Hence, as in the previous example, a primary operation is performed on one well entirely by the drilling rig 132 of the mobile offshore drilling unit, while a parallel, secondary operation is performed by the remote well-processing device on the platform which provides structural support to the remote well-processing device, but where the secondary operation is otherwise facilitated by equipment on-board the mobile offshore drilling unit.

Figure 3:
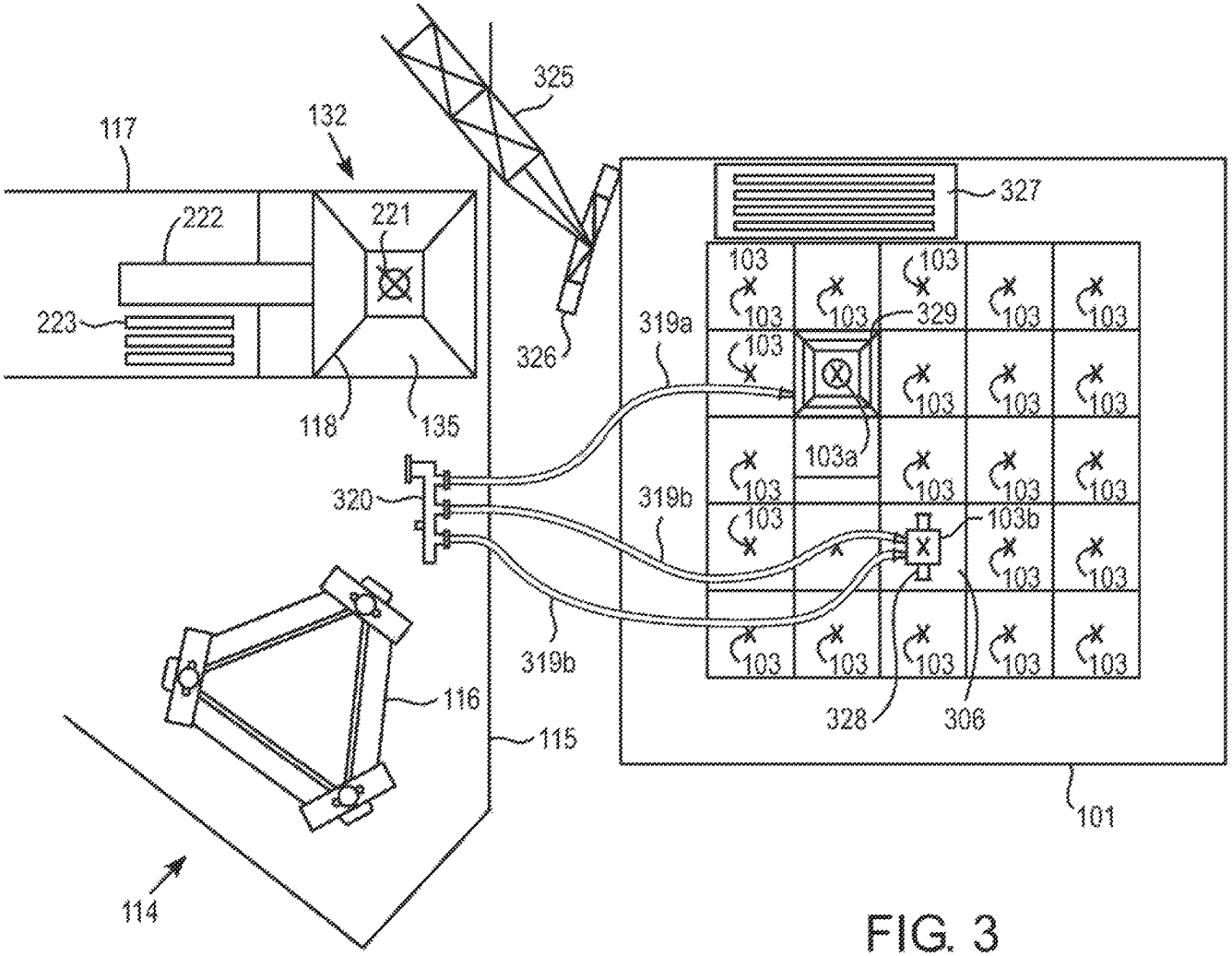
FIG. 3 schematically illustrates another example of an off-shore well-processing system.

FIG. 3 schematically illustrates another example of an off-shore well-processing system. In particular, shows a top view of a mobile offshore jack-up drilling unit 114 positioned adjacent an oil production platform 101 as described above. The features of the jack-up unit that have already been described in detail in connection with FIGS. 1 and 2 will not be described in detail again, but they are referred to by the same reference numerals as in FIGS. 1 and 2.

The system of FIG. 3 comprises two remote well-processing devices 306 and 329, respectively. Remote well-processing device 329 is shown positioned on the offshore platform 101 above a well slot 103*a* while remote well-processing device 306 is shown positioned on the offshore platform 101 above a well slot 103*b*. However, both remote well-processing devices may be repositioned to other well slots 103, e.g. as described in connection with FIG. 1. In the example of FIG. 3, the remote well-processing device 206 comprise a work platform and a fluid interface 238, e.g. as described in connection with FIG. 2. The fluid interface 238 is connected by flow lines 319*b* to a manifold 320 located on the jack-up unit. The manifold may in turn be connected to a pump station, e.g. a mud pump (not shown in FIG. 3), of the jack-up unit. The manifold 320 may be the same manifold which also services the primary drill rig 132 of the jack-up unit, or it may be an additional manifold in addition to the manifold which also services the primary drill rig 132 of the jack-up unit.

The other remote well-processing device 329 comprises a derrick or other support structure and a hoisting system configured to raise or lower tubulars through the well centre 103*a*. The remote well-processing device may further comprise a blow-out-preventer and further equipment such as break-out tongs and/or shearing devices, and/or a top drive. The remote-well processing device thus provides satellite drill floor in addition to the drill floor 135 of the drill rig of the jack-up unit. It will be appreciated that the drill rig of the remote well-processing device 329 may have the same rating or a different, e.g. a lower, rating compared to the drill rig 135. The remote well-processing device 329 is skiddable mounted e.g. on skid beams 330 traversing the grid of well slots 103. The jack-up unit assists the remote well-processing device 329, e.g. via a flow line connection 319*a* which may be connected to manifold 320 or to a separate manifold of the jack-up unit. Hence, the remote well-processing device 329 may receive mud, cement and/or other fluids from the jack-up unit. Additionally or alternatively, the remote well-processing device 329 may receive hydraulic and/or electrical power from the jack-up rig. The remote well-processing device 329 may further be controlled from a driller's cabin or other control station of the jack-up unit via suitable communication lines. The remote well-processing device 329 may also utilise pipe storage and pipe handling facilities of the jack-up unit. For example, pipes may be transferred between a storage area 223 of the jack-up unit and a temporary storage area 327 of the offshore platform 101. This transfer may be performed by a crane 325 of the jack-up unit and/or by other pipe handling equipment of the jack-up unit and/or by a pipe handling apparatus extending between the jack-up unit and the platform 101. The pipes may be transferred individually or as stacks of multiple pipes.

Hence, as in the previous examples, a primary operation is performed on one well while a secondary operation is performed on another well. However, in this example, both operations are performed by respective remote well-processing devices. It will be appreciated, however, that the drill rig of the jack-up unit may be used to operate on a third well concurrently with the operation of the two remote well-processing devices.

As in the previous examples, the offshore platform 101 provides structural support to the remote well-processing devices, but where the operations performed by the remote well-operating devices are assisted/facilitated by equipment on-board the mobile offshore drilling unit.

Figure 4:
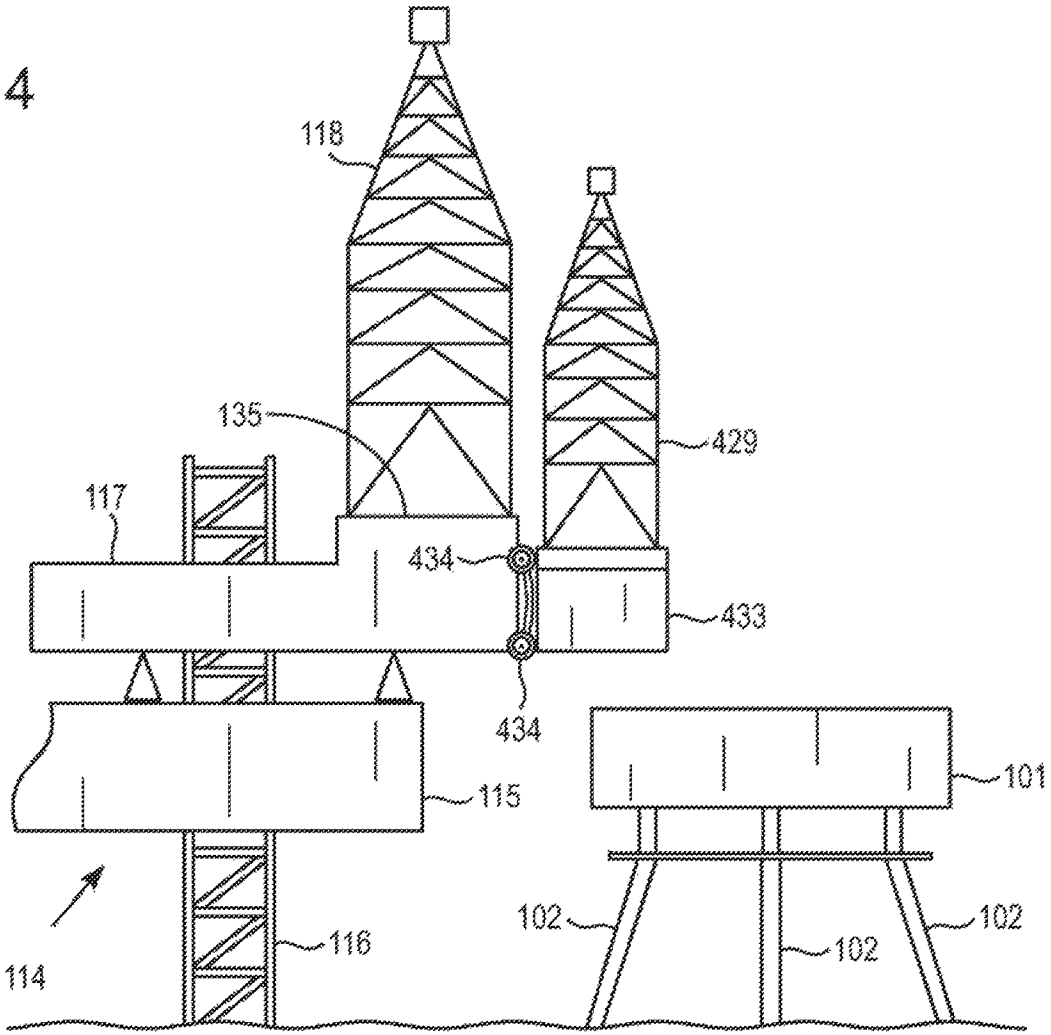
FIG. 4 schematically illustrates another example of an off-shore well-processing system.

FIG. 4 schematically illustrates another example of an off-shore well-processing system. In particular, shows a side view of a mobile offshore jack-up drilling unit 114 positioned adjacent an oil production platform 101 as described above. The features of the jack-up unit that have already been described in detail in connection with FIGS. 1-3 will not be described in detail again, but they are referred to by the same reference numerals as in FIGS. 1-3. In the example of FIG. 4, the cantilever 117 of the jack-up unit 114 is equipped with connectors 434 to which a remote well-processing device 429 can be detachably connected, such that the cantilever can position and set-off the remote well-processing device onto the platform 101. It will be appreciated that the re-positioning of the well-processing device 429 between well slots may also be performed by the cantilever. Alternatively, the remote well-processing device 429 may be repositioned by other means e.g. by a skidding arrangement as described above. The positioning of the remote well-processing device may be particularly advantageous in embodiments where the remote well-processing device 429 comprises a large structure such as a mast and a hoisting system (e.g. the device 329 described in connection with FIG. 3) and a satellite drill floor, since even large structures may be positioned in one piece. In the example of FIG. 4, the well-processing device comprises a derrick, mast or similar hoisting/drilling support structure and a substructure 433 or ponybase supporting the derrick or similar hoisting/drilling support structure. The substructure provides an interface to the offshore platform, e.g. facilitating skidding etc.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention. For example, embodiments of the invention have mainly been described with reference to a jack-up unit. It will be appreciated, however, that embodiments of the system described herein may also be used in connection with other types of mobile offshore drilling units.

In device claims enumerating several features, several of these features can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore well-processing system for performing one or more well-processing tasks, the system comprising:

a mobile offshore drilling unit and a remote well-processing device configured to be mounted on an offshore platform separate from the mobile offshore drilling unit, the mobile offshore drilling unit defining at least one well centre and comprising at least one primary drill rig comprising at least one drill floor and at least one hoisting system for raising and lowering tubular equipment through the at least one well centre from/into a well in the seafloor; and wherein the remote well-processing device is configured to perform at least a first of the one or more well-processing tasks when mounted on said offshore platform at a position displaced from the at least one well centre defined by the mobile offshore drilling unit; and wherein the mobile offshore drilling unit and the remote well-processing device are configured to be operationally coupled to each other when the remote well-processing device is mounted on said offshore platform; and wherein the mobile offshore drilling unit is configured to assist concurrently in two or more of the well-processing tasks performed concurrently on respective wells, including the first well processing task performed by the remote well-processing device on a first well and a second well-processing task concurrently performed by the offshore well-processing system on a second well.

2. The offshore well-processing system according to claim 1, wherein the offshore well-processing system includes the offshore platform.

3. The offshore well-processing system according to claim 1, wherein the mobile offshore drilling unit and the remote well-processing device are configured to be operationally coupled to each other so that the remote well-processing device utilizes one or more of the well-processing facilities of the mobile offshore drilling unit.

4. The offshore well-processing system according to claim 1, wherein the mobile offshore drilling unit and the remote well-processing device are configured to be operationally coupled to each other by respective flow lines, utility lines, or communications lines.

5. The offshore well-processing system according to claim 2, wherein the mobile offshore drilling unit and the remote well-processing device are configured to be operationally coupled to each other so that the remote well-processing device utilizes one or more of the well-processing facilities of the mobile offshore drilling unit.

6. The offshore well-processing system according to claim 2, wherein the mobile offshore drilling unit and the remote well-processing device are configured to be operationally coupled to each other by respective flow lines, utility lines, or communications lines.

* * * * *